US005611185A

United States Patent [19]

Wilz

[11] Patent Number: 5,611,185

[45] Date of Patent: Mar. 18, 1997

[54] SURFACE MOUNTED GRID SYSTEM AND PROCESS OF INSTALLATION

[75] Inventor: Steve C. Wilz, Appleton, Wis.

[73] Assignees: Thomas B. Van Wyk; Linda M. Van Wyk, both of Appleton, Wis.

[21] Appl. No.: 424,129

[22] Filed: Apr. 19, 1995

[51] Int. Cl.[6] ..... E04B 9/00

[52] U.S. Cl. ..... 52/506.07; 52/489.2; 52/395; 52/461; 52/471; 52/747.1

[58] Field of Search ..... 52/506.07, 489.2, 52/395, 461, 466, 468, 471, 747.1

[56] References Cited

U.S. PATENT DOCUMENTS

| | | | |
|---|---|---|---|
| 3,263,388 | 8/1966 | Bogert | 52/489.2 X |
| 3,565,473 | 2/1971 | Kedel | 52/489.2 X |
| 3,857,216 | 12/1974 | Sherman | 52/489.2 |
| 3,969,865 | 7/1976 | Anderson | 52/483 |
| 4,027,454 | 6/1977 | Schuplin | 52/489.2 X |
| 4,067,155 | 1/1978 | Ruff et al. | 52/105 |
| 4,300,323 | 11/1981 | Meehan et al. | 52/466 X |
| 4,434,599 | 3/1984 | McCall | 52/729 |
| 4,720,946 | 1/1988 | Pagliarello | 52/489.2 X |
| 4,858,408 | 8/1989 | Dunn | 52/489.2 |

*Primary Examiner*—Wynn E. Wood
*Attorney, Agent, or Firm*—R. Jonathan Peters

[57] ABSTRACT

A grid system for supporting panels and adaptable for use in association with a substructure, comprising a plurality of spaced, horizontally disposed main runners and cross-runners arranged perpendicular to each other. The main runners are adaptable for attachment to the substructure, and include (i) a crosspiece having a horizontally oriented surface provided with a plurality of spaced notches and (ii) a downwardly depending member terminating with a horizontally disposed flange. The cross-runners have horizontally disposed flanges arranged in a common plane with the flanges of the main runners, which support the tile panels in a common plane. The cross-runners include connecting means for insertion in the notches upon the perpendicular arrangement, and the connecting means have a horizontally oriented surface for mating with the surface of the crosspiece and disposed for overlapping engagement with the crosspiece thereby supporting the cross-runner and preventing undesired disengagement therebetween.

21 Claims, 4 Drawing Sheets

SURFACE MOUNTED GRID SYSTEM AND PROCESS OF INSTALLATION

FIELD OF INVENTION

This invention relates to a surface mounted grid system, and to the process of installation. In its more specific aspect, this invention relates to a surface mounted grid system adaptable for use in association with a substructure such as a ceiling, roof, or wall, to support an array of panels such as acoustical tile panels, and to the process of installation.

BACKGROUND AND PRIOR ART

Ceiling grid systems, comprised of horizontal runners, for supporting tile panels such as acoustical ceiling tile are used extensively in both new and remodeled building and room structures. The grid typically consists of main runners and cross-tees, having lateral supporting shoulders or flanges, and are arranged perpendicular to each other to form a rectangular pattern. The runners most typically are suspended by a wire connected to an existing ceiling or exposed framing member, and the cross-tees are attached or mounted to the runners in a perpendicular direction to form a rectangular pattern. Less frequently, the grid is installed without suspension by nailing the runners directly to the ceiling or framing members, and then connecting the cross-tees normal to the runners. After the grid is installed, the tile panels are eased into place onto the supporting flanges of the runners and cross-tees. A grid system offers many advantages such as increasing a room's energy efficiency, improving a room's acoustics, and enhancing the aesthetic value of a room, and a suspended system is further advantageous in that it provides means for lowering a ceiling, and/or allowing for the installation of electrical fixtures, pipes and duct work.

Ceiling grid systems are relatively inexpensive and easy to install as compared to a plaster ceiling. As a consequence, there is a continuing need to improve on the design and integrity of the grid system, particularly in light of the fact that many systems are installed in commercial buildings requiring years of service, or installed by the do-it-yourself home owner. What is available or disclosed in the prior art exhibit certain deficiencies or disadvantages, however, particularly with respect to a surface mounted system. For example, U.S. Pat. No. 3,263,388 to Bogert discloses a ceiling tile installation, which includes an anchor 14 having a base flange 14*a* for nailing to a wood joist, and a bifurcated web 14*b* with internal teeth 18 extending transversely from the flange. The T shaped runner 15 has a transverse web 15*b* with teeth 18 on the outer surface which interlock with the teeth of the bifurcated web when the runner is engaged with the anchor, and the base flange 15*a* supports the tile panel along its marginal edge.

There is disclosed in U.S. Pat. No. 3,857,216 to Sherman a panel suspension system comprising a top element 14*a* of a T configuration having a web 20 with outwardly disposed teeth 30, and a bottom element 14*b* of a T configuration but with a bifurcated web 32 having internal teeth 33 and adapted to receive, and frictionally retain, the web of top element 14*a*. In practice, the top element is fastened to a joist 25, a ceiling panel 15 is then placed against the top element, and the bottom element is pushed upwardly so that the teeth of the top and bottom webs matingly engage and hold the ceiling panel in place.

U.S. Pat. No. 4,067,155 to Ruff provides a sealed joint between panels. The system disclosed is for joining and adhering a pair of abutting panels to a rigid substrate to provide a seal against thermal and moisture transfer. The system includes mating T members comprising receptacle 16 having a base 20 for nailing to a substrate, and insert 18 having a resilient, deformable cap 60. When the members are engaged and frictionally retained by reason of the mating teeth 32 and 64, a force on the resilient, deformable cap provides an upward force against the interlocking teeth thereby providing a secure engagement not susceptible to removal or loosening.

A weather tight seal for a roof or wall is disclosed in U.S. Pat. No. 3,339,329. According to the teachings of this patent, the panel cover includes an inverted channel member 12, which is nailed to the roof, and has a centrally located cleft 30 with a constriction 34. A locking bar 42 having a T-like configuration and terminating with a wedge 46 is inserted through a sealing compound 36 and into the cleft where it is engaged by the constriction.

The prior art, however, exhibits certain deficiencies or disadvantages. For example, a suspended grid system is not always necessary, and is generally more time consuming and has added expense as compared to a surface mounted system. Also, known systems typically require mounting a section only of the runners, then inserting the panel, and then mounting the remainder of the runners, whereas it generally would be simpler to first install completely the grid and then insert the panels.

This invention has, therefore, as its purpose to provide an improved grid system which can be surface mounted in association with a substructure or framing member, such as a joist.

It is another object of the invention to provide a grid system of the above character made from a plurality of interlocking and connecting elements which can be readily assembled to yield a grid of any desired dimension.

It is yet another object of the invention to provide a grid system of the above character which provides for immediate and easy adjustment in order to accommodate tile panels of different thicknesses.

This invention has as still another object to provide a grid system of generally modular construction which lends itself to complete fabrication from regularly employed materials, particularly plastics.

In yet another object of the invention to provide a grid system which, after installation, provides easy access for opening a grid at any desired location such as the need to replace a soiled or damaged tile panel.

Still another object of the invention is to provide a ceiling grid system installed by a process which is relatively simple and less time consuming than usually required for a typical suspended grid system.

SUMMARY OF THE INVENTION

In accordance with my invention, there is provided a surface mounted grid system for supporting an array of tile panels and adaptable for use in association with a substructure, such as a wood joist or other suitable framing member, or an existing ceiling. Although the grid system is described herein with particular emphasis on a system to support ceiling tile, it should be understood that the grid system can support any panel other than ceiling panels, or can be used on any substructure such as a wall. Broadly, the grid system of my invention comprises a plurality of spaced, horizontally disposed main runners and cross-runners, which are arranged substantially perpendicular to each other to form a rectangular pattern. The main runners, which are adaptable for attachment to the substructure, comprises a crosspiece having a horizontally oriented surface provided with a plurality of spaced notches and a downwardly depending member terminating with a horizontally disposed flange. The cross-runners are arranged substantially perpendicular to the main runners, and have a horizontally oriented flange disposed in a common plane with the flange of the main runners. Thus, the transverse terminal edge of the flange of the cross-runner abuts the longitudinal terminal edge of the flange of the main runner. In this manner, the flanges of the main runners and the flanges of the cross-runners support the tile panels in a common plane. The crosspiece may be attached to the substructure, as with screws or staples at spaced intervals; or where desired, the main runner may include a base or facia for attachment to the substructure, and the crosspiece depends laterally from the fascia and is spaced therefrom and disposed between the facia and the flange. The cross-runner includes connecting means for insertion into or through the notches of the crosspiece upon the perpendicular arrangement of the runners. The connecting means includes a horizontally oriented surface for mating with the surface of the crosspiece, and is disposed for overlapping engagement with the crosspiece thereby supporting the cross-runner and preventing undesired disengagement between main runner and the cross-runner.

In a more specific embodiment, each of the main runners and the cross-runners are comprised of top members and bottom members which, upon engagement, form or define a groove, recess or rabbet for seating the marginal edge portion of a panel and holding it in place, as explained below in more detail. The top members of the runners have (i) a substantially flat fascia or crosspiece adaptable for mounting or attachment to the substructure, and (ii) spaced, non-peripheral, longitudinal, flexible side walls which extend transversely from the fascia to provide a flexural channel opening. The inside channel walls of the top member have at least one inwardly directed flange or detent. The bottom members of the runners are of substantially T configuration in transverse cross-section having (i) a flange and (ii) an intermediate longitudinal web extending transversely therefrom and provided with at least one projection, boss or barb. The channel opening of the top member is adapted to receive the web of the lower member, the internal flange or detent of the channel walls providing a co-operable interlocking element with the projection of the web of the bottom member to prevent undesired disengagement therebetween. In this manner, the bottom member, depending from the top member, is retained in engagement with the top member.

The fascia of the top member of the main runner is provided with a plurality of spaced notches adaptable to receive the side channel walls of the top member of the cross-runner when the two runners are arranged perpendicular to each other, and the fascia of the top member of the cross-runner overlaps with the fascia of the top member of the main runner. It will be observed that the flange of the bottom member and the fascia of the top member define a groove, recess or rabbet adaptable to receive and hold in place a tile panel. Further, the depth of this groove is adjustable and can therefore accommodate panels of varying thicknesses. It is preferable that upon engagement of the two members, the transverse marginal edge of the flange of the lower member of the cross-runner abuts the longitudinal marginal edge of the flange of the lower member of the main runner.

In accordance with an alternative embodiment of my invention, the flange or detent on the inside of each of the channel walls of the top member is disposed inwardly from the longitudinal marginal edge of the side wall. In order to enhance the co-operable interlocking means of the top and bottom members, the internal flange on the channel walls has an inwardly disposed shoulder, preferably a planar shoulder, substantially normal to the channel wall, and the web of the lower or bottom member has a first projection or barb with an inwardly disposed shoulder, preferably a planar shoulder, substantially normal to the web. This first projection is disposed along or adjacent the longitudinal marginal edge of the web and extends substantially the full length thereof. A second longitudinal projection spaced inwardly from the first projection extends substantially the full length of the web. Upon engagement of the web of the bottom member in the channel, the shoulder of the first projection seats in mating engagement with the shoulder of the internal flange, and the second projection positioned on the opposite side of the internal flange nearly borders or abuts the inside wall of the channel and thereby inhibits rocking.

In an alternative embodiment of the invention, the top member of the main runner is provided with a crosspiece comprising lateral shoulders disposed substantially parallel to and spaced below the fascia, thereby defining or forming a re-entrant groove, recess or rabbet for seating the transverse marginal edge portion of the fascia of the top member of the cross-runner upon perpendicular arrangement of the two runners. In a preferred construction, a flange depends downwardly from opposed sides of the fascia, and the horizontally disposed shoulder extends or projects outwardly from each flange. The shoulder, however, preferably does not extend beyond the longitudinal marginal edge of the fascia. A plurality of spaced notches are formed in the lateral shoulders of the top member of the main runner. In accordance with one embodiment, the notch receives the side channel walls of the top member of the cross-runner when the two runners are arranged perpendicular to each other, and the fascia of the top member of the cross-runner overlaps with the shoulder of the top member of the main runner. Also, upon assembly for the embodiment of this description, the transverse marginal edges of the channel walls are brought into abutment with the flange extending below the shoulder. In a preferred embodiment, the cross-runner comprises a bottom member only, as described above, and the notch in the crosspiece or shoulder is adaptable to receive the web of the bottom member. In this manner, the substantially planar surface of the barb seats on the surface of the shoulder, and the overlapping engagement supports the cross-runner and prevents any undesired disengagement between the two runners. The construction design of this type of embodiment utilizing lateral shoulders disposed beneath a fascia, and between the fascia and the flange, enhances the integrity of the assembly, and further provides for easier and quicker installation, and improves the aesthetic value.

DETAILED DESCRIPTION OF THE INVENTION

Figure 1:
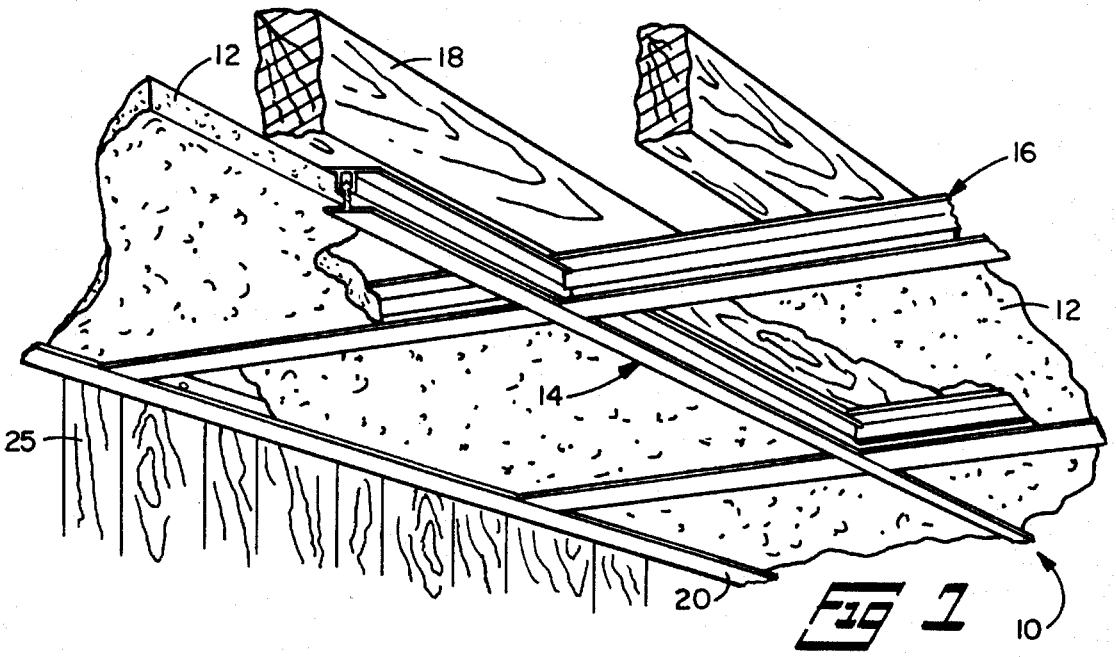
FIG. 1 is a perspective view of a ceiling grid system, looking upward, of the present invention.

Referring to the drawings, wherein the same reference numerals refer to similar parts throughout the several views, there is shown in FIG. 1 a grid system of the present invention, indicated generally by the numeral 10, installed on a ceiling and supporting ceiling tile 12. In accordance with one embodiment of the invention, the grid system 10 comprises a plurality of main runners, indicated generally at 14, and cross-runners, indicated generally at 16, disposed substantially perpendicular to the main runners. The main runners 14 are spaced at predetermined distances in parallel rows, and the cross-runners 16 are similarly spaced in parallel rows normal to the main runners, thereby forming a rectangular grid for supporting the tiles. As shown in FIG. 1, the main runners 14 are affixed or fastened to a substructure such as the wooden joist 18, or similar framing member, by any suitable means such as nails, screws, or the like. It should be understood, however, that for some installations it may be better or more appropriate to mount the cross-runner 16 to the joist, but this will depend on such factors as the construction and lay-out of the substructure, room dimensions, and tile size. Also, if the grid is attached to a plaster ceiling (not shown), it is more desirable to use anchor bolts or the like. Wall angle bracket or wall molding 20 is attached to the wall 22 at or near the edges of the ceiling (in practice, the molding is attached to all the walls of the room) and at about the same height as the runners, and supports the runners and ceiling panels at the marginal edges. The wall molding may be of any conventional construction, and typically comprises a vertical backing plate and a horizontal flange. Thus, the wall molding is properly aligned, and the backing plate is attached to the wall by such means as nailing or the like. The horizontal flange supports the panels and runners.

Figure 3:
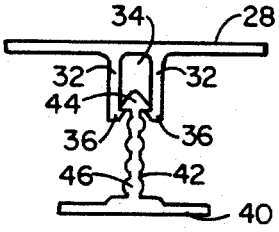
FIG. 3 is an elevational end view showing the members of FIG. 2 brought into engagement.
Figure 2:
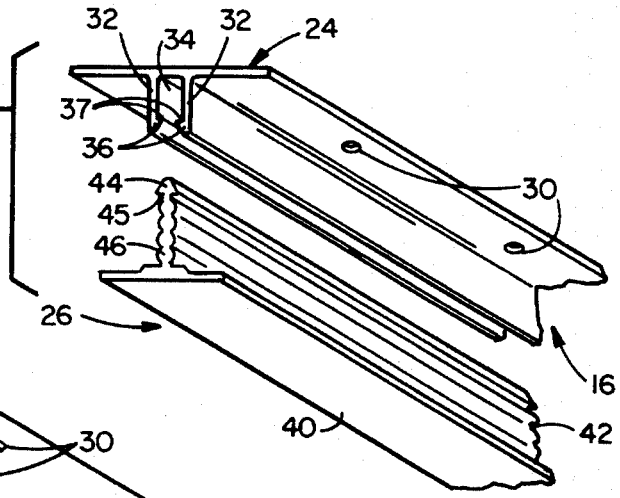
FIG. 2 is an exploded perspective view showing in more detail the upper and lower members of a runner employed in the grid system of the invention.
Figure 4:
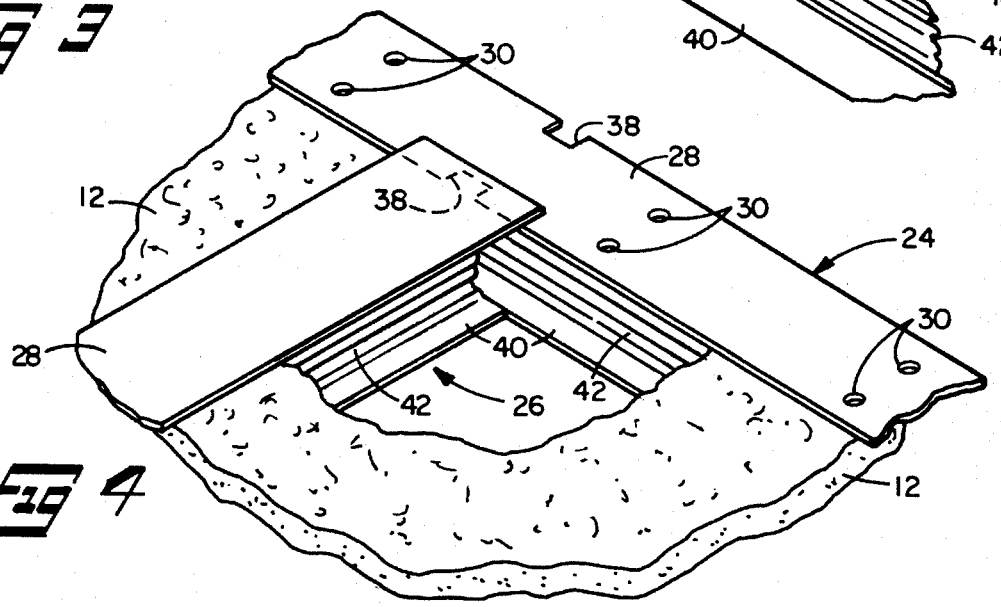
FIG. 4 is a perspective view showing in more detail the main runner and cross-runner after assembly.

There is shown in FIGS. 2–4 greater details of the runners and the assembly of the members. It should be noted that the main runner and cross-runner are of similar structure, with one significant exception described below, and therefore the description of one type is applicable to the other unless otherwise noted. Also, it should be noted that the runners are typically made of plastic, or metal, which materials are well known and used for ceiling grid systems. As best seen in FIG. 2, runner 16 comprises a top member (e.g. crosspiece) 24 and complementary bottom member 26. Top member 24 has a substantially flat, elongated fascia or backing 28 adaptable to be affixed or mounted to the substructure, such as joist 18, such as by nailing or the like. Desirably, the fascia is prepunched with holes 30 to accommodate nails or screws. Depending downwardly from the fascia 28 are two spaced, non-peripheral side walls 32 which run about the complete longitudinal length of the fascia runner, and preferably are co-terminus therewith. The side walls are flexible, either by being formed of a flexible material, and/or being of such a gauge as to exhibit flexibility. It thus will be observed that the side walls form a longitudinal channel 34 for receiving the bottom member 26, as described below in greater detail. Preferably, the side walls 32 are parallel, but where desired the walls may converge slightly in order to provide for better retention of the lower member. Further, both side walls 32 are provided with internal flanges or detents 36 at or adjacent the terminus of the walls. The detent 36 preferably has an inwardly disposed, planar shoulder 37 which is substantially normal to the side wall, for reasons explained below. Additionally, the fascia 28 of the top member 24 of the main runner 14 has a plurality of spaced notches 38 (see FIG. 4) adaptable to receive the side walls 32 of the top member 24 of the cross-runner 16 when, upon assembly of the runners, the cross-runner is arranged perpendicular to the main runner.

Bottom member 26 of both runners is of substantially T configuration in cross-section, comprising a flange 40 for supporting a tile panel and an intermediate transverse web 42 extending longitudinally therefrom. Projection, boss or barb 44 at or adjacent the outer terminus of the web 42 extends for substantially the complete longitudinal length thereof, and preferably is co-terminus therewith. Preferably, the underside of the projection 44 has a planar shoulder 45 which is substantially normal to the web. Where desired, the web 42 may have one or more strengthening ribs 46.

The runners 14 and 16 are assembled substantially as shown in FIGS. 3 and 4. The fascia 28 of the top runner 24 of the main runner 14 is first nailed or screwed to the substructure, e.g., ceiling joist. The bottom member 26 of the main runner 14 is then conjoined with the top member 24 by inserting the web 42 into the channel 34, and then slowly retracting the bottom member until the shoulder of projection 44 seats on the shoulder of flange 36. The engagement of these two members is clearly illustrated in FIG. 3. It will be observed that the tile supporting flange 40 of the bottom member 26 and the fascia 28 of the top member 24 define a groove, recess or rabbet adaptable to receive a tile panel. Thus, the cross-runners 16 are similarly engaged, and the cross-runners are then assembled with the main runners as shown in FIG. 4. That is, the cross-runners are installed perpendicular to the main runners by inserting the channel walls 32 into the notches 38. The fascia 28 of the cross-runner 16 overlaps with the fascia 28 of the main runner 14, and desirably the transverse marginal edge of flange 40 of the bottom member 26 of the cross-runner 16 abuts the longitudinal marginal edge of flange 40 of the bottom member 26 of the main runner 14. Tile panels 12 are then eased into position, and the bottom members of both runners may be adjusted to accommodate the thickness of the tile. It will be observed that the tile panels lay substantially in a common plane with the flanges of the main and cross-runners.

Figure 5:
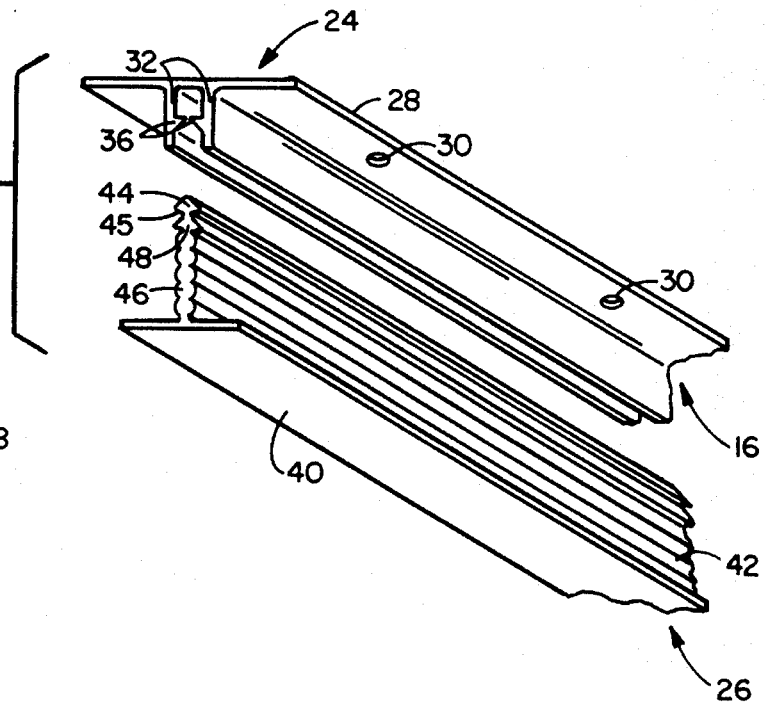
FIG. 5 is an exploded perspective view showing alternative embodiments to the upper and lower members of a runner of the present invention.
Figure 6:
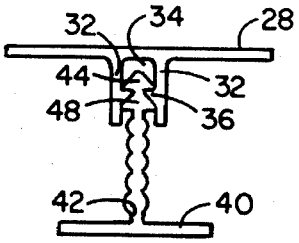
FIG. 6 is an elevational end view showing the members of FIG. 5 brought into engagement.

In accordance with an alternative embodiment shown in FIGS. 5 and 6, the flange or detent 36 protruding from the internal channel walls 32 is disposed inwardly from the terminal edge of the walls. It is advantageous to position the flange inwardly from the edge because a flange in this position is stronger than a terminal flange, and additionally allows for easier adjustment of the bottom member. In conjunction with this embodiment, I have found as a further modification to provide the web 42 of the bottom member 26 with a second projection or boss 48. When the members are assembled substantially as described above and as shown in FIG. 6, it will be observed that the second projection about borders or abuts the internal walls 32 of the channel 34. This feature is especially advantageous in that it inhibits rocking of the bottom member.

Figure 7:
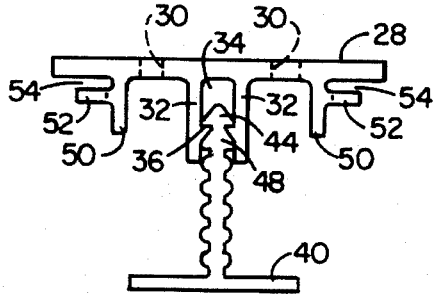
FIG. 7 is an elevational view showing a further alternative embodiment of the top member of a main runner.
Figure 8:
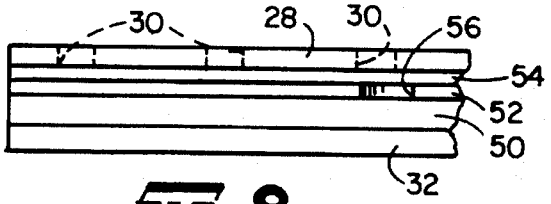
FIG. 8 is a longitudinal elevational view of the top runner of FIG. 7 rotated 90 degrees.
Figure 9:
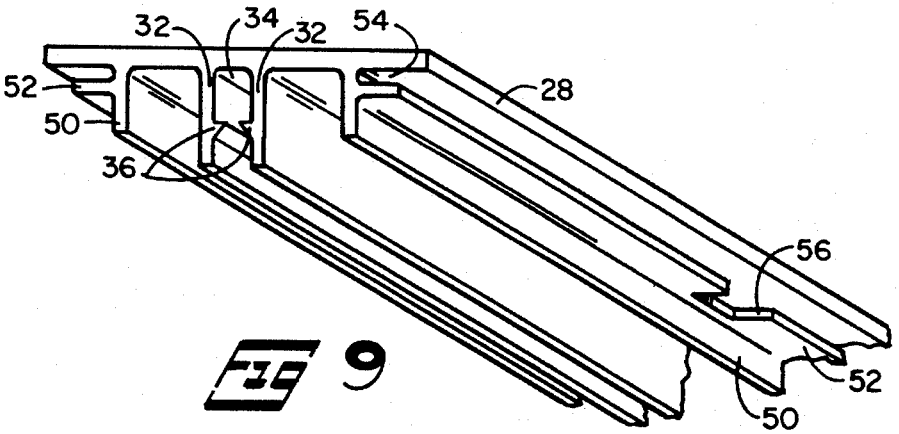
FIG. 9 is a perspective view of the top runner of FIG. 7.

In another embodiment of my invention as shown in FIGS. 7–11, there is shown a top member 24 having a fascia 28 and downwardly depending walls 32 forming channel 34, as described above with reference to the other embodiments. Flange 50 depends downwardly from the fascia and to each side of the channel walls so as to be spaced therefrom. Intermediate shoulder 52 extends transversely from the flange 50, but not beyond the longitudinal marginal edge of the fascia and preferably indented from the marginal edge as best seen in FIG. 7. The term "intermediate" as used herein and in the appended claims is not limited to mean in the middle, but rather includes between the extremities. It will be observed that the shoulder 52 is spaced below the fascia 28 and substantially parallel thereto as to be laterally disposed with reference to the fascia, thereby defining or forming re-entrant groove, recess or rabbet 54. A plurality of spaced notches 56 (see FIGS. 8 and 9) is formed in the shoulders adaptable to receive the channel side walls 32 of the top member 24 of the main runner 14 when the two runners are arranged perpendicular to each other.

Figure 10:
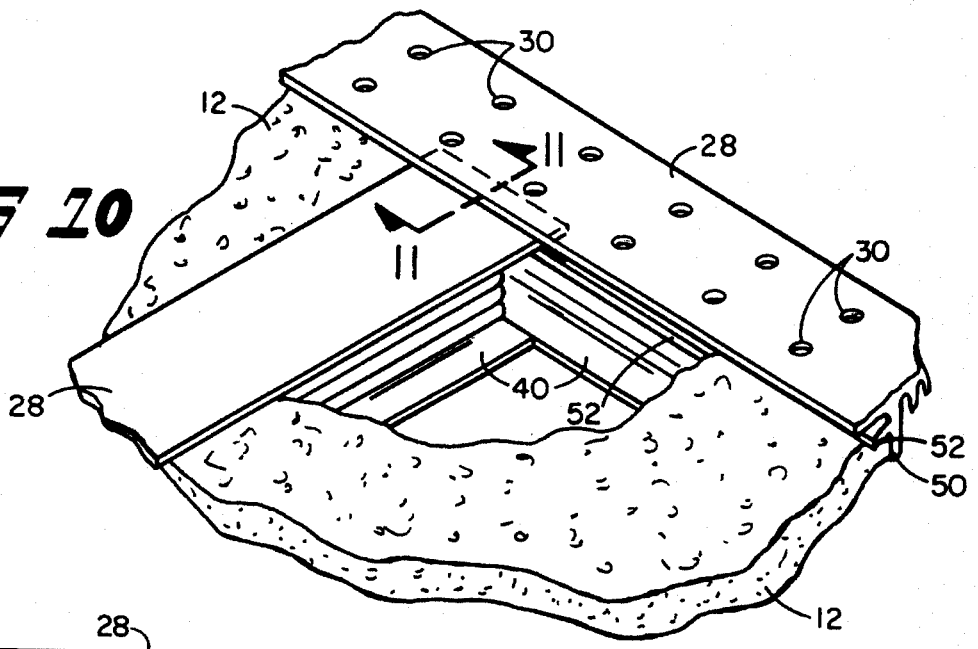
FIG. 10 is a perspective view of the embodiment of FIG. 7 showing the main runner and cross-runner after assembly.
Figure 11:
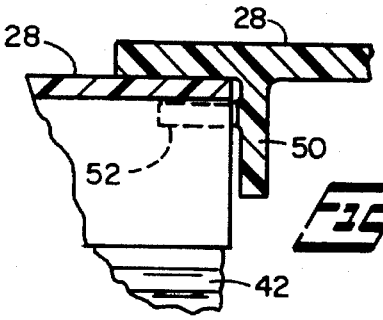
FIG. 11 is an elevational, sectional view taken on line 11—11 of FIG. 10.
Figure 12:
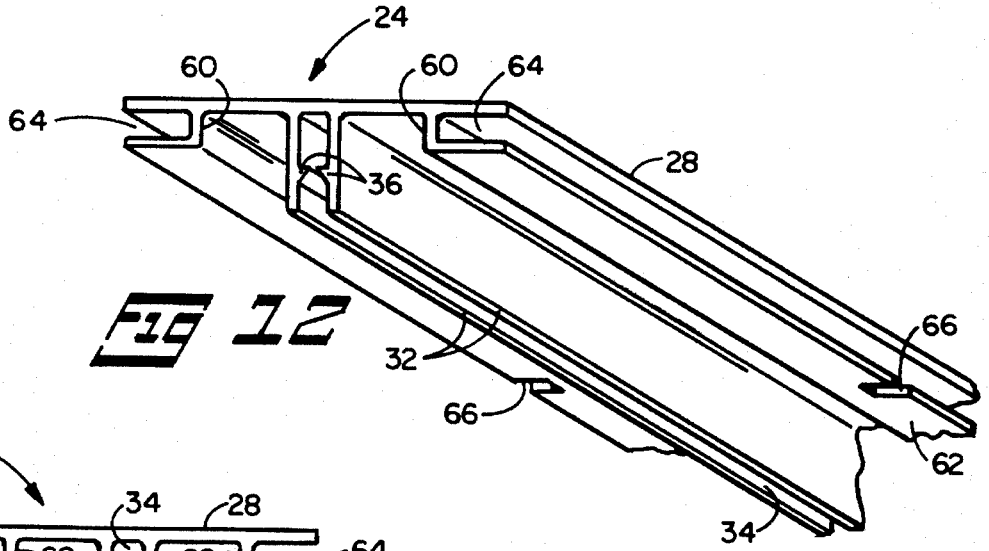
FIG. 12 is a perspective view of a top main runner showing another alternative embodiment of the invention.

Upon assembly of the members of this alternative embodiment, the top and bottom members 24 and 26, respectively, are engaged and interlocked, as shown in FIG. 7 and as described above with reference to the other embodiments. The top member of the cross-runner 16 is brought into perpendicular arrangement with the top member of the main runner 14 at the notches 56 which receive the side channel walls 32. In this manner, the fascia 28 of the top member of the cross-runner enters groove 54 such that the fascia overlaps with the shoulder 52. Hence, the groove 54 defined by the shoulder and the fascia of the top member of the main runner holds more firmly in place the cross-runner than the free overlapping position as shown in the other embodiment. Also, when the members are assembled, the transverse marginal edge of the channel walls 32 of the top member 24 of the cross-runner are brought into abutment, or near abutment, with the flange 50, and desirably the transverse marginal edge of flange 40 of the bottom member 26 of the cross-runner 16 abuts the longitudinal marginal edge of flange 40 of the bottom member 26 of the main runner 14. When the assembly is complete, as shown in FIGS. 10 and 11, the tile panel 12 is eased into place. Because the grid system is characterized by high integrity, the ceiling is now secure.

Figure 13:
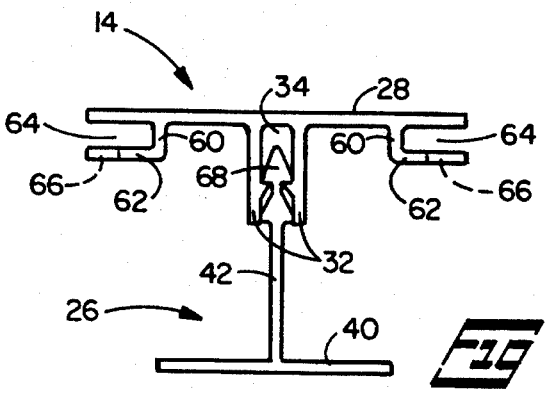
FIG. 13 is an elevational end view of the embodiment of FIG. 12 showing the assembly of the main runner.
Figure 14:
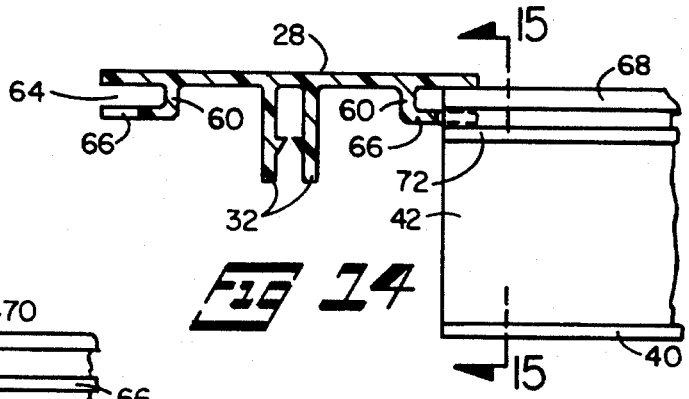
FIG. 14 is an elevational view, partly in cross-section, showing the assembly of the top member of FIG. 12 with the bottom member as the cross-runner.
Figure 15:
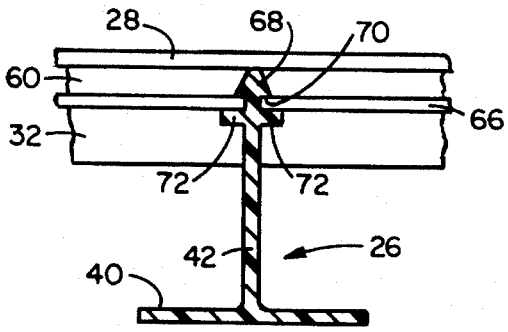
FIG. 15 is a sectional view on line 15—15 of FIG. 14.
Figure 16:
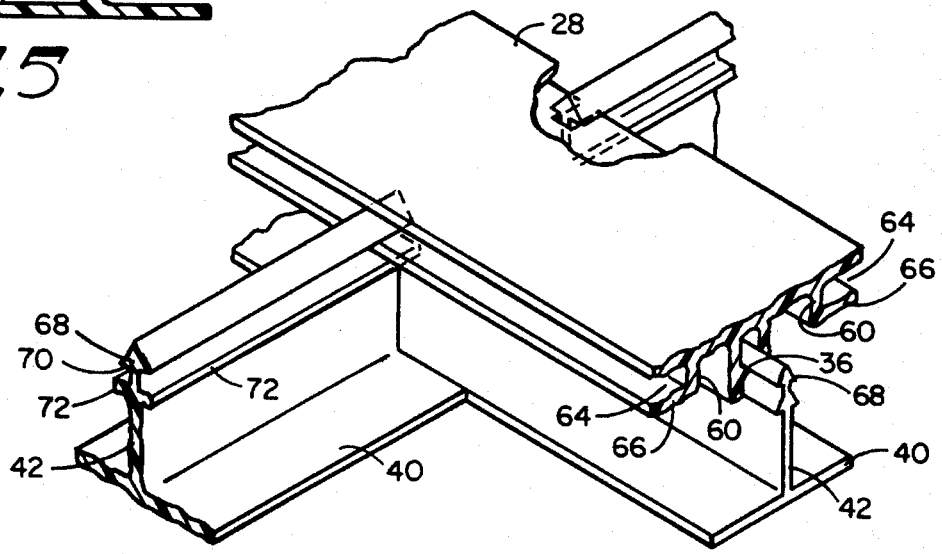
FIG. 16 is a perspective view of the embodiment of FIGS. 12–15 showing the main runner and cross-runner after assembly.

In a preferred embodiment of my invention as shown in FIGS. 12–16, the main runner 14 includes a top member 24 and a bottom member 26, substantially as described above, but the cross-runner comprises solely the bottom member 26. Accordingly, there is shown a top member 24 having a fascia 28 and downwardly depending walls 32 forming channel 34, as described above with reference to the other embodiments. Flange 60 depends downwardly from the fascia and on opposed sides of the channel walls so as to be spaced therefrom. Lateral shoulder 62 projects or extends transversely from the flange 60, but not beyond the longitudinal marginal edge of the fascia, and preferably about coterminates with the marginal edge of the fascia, as best seen in FIGS. 13 and 14. It will be observed that shoulder 62 is spaced below the fascia 28 and substantially parallel thereto so as to be laterally disposed with reference to the fascia, thereby defining or forming re-entrant groove, recess or rabbet 64. Further, shoulder 62 is formed of a flexible resilient material (e.g., plastic). A plurality of spaced notches 66 (see FIGS. 12 and 13) is formed in the shoulders adaptable to receive the web 42 of the bottom member 26 when arranged perpendicular to the top member 24 of the main runner. In order to provide a suitable connection between the two members, the terminus of web 42 has barb 68, which preferably has a substantially planar surface 70 for mating engagement with the planar surface of shoulder 62. The notch 66 is slightly smaller than the width of the projection or barb 68, and because the shoulder is fabricated of a flexible material, such as a plastic, the shoulder opening or notch can be spread to admit the projection or barb, and the bottom member then pulled downwardly to bring the planar surfaces into mating engagement. Thus, this overlapping engagement of the planar surfaces of the projection and of the shoulder provides support for the cross-runner, and prevents undesired disengagement of the members. Where desired, opposed lateral shoulders 72 are formed on web 42 spaced inwardly from the barb of a distance slightly greater than the thickness of shoulder 62 of the top member 28. Thus, upon assembly the barb is inserted into the notch 66, and the lateral shoulders 72 abut or nearly abut the undersurface of the shoulder 62 of the top member, thereby inhibiting any rocking of the bottom member 26.

Upon assembly of the members of this alternative embodiment shown in FIGS. 12–16, the top and bottom members 24 and 26, respectively, are engaged and interlocked, as shown in FIG. 13 and as described above with reference to the other embodiments. The bottom member 26 is brought into perpendicular arrangement with the top member of the main runner 14 at the notches 66 which receive the web 42 such that the planar surface 70 of projection or barb 68 overlaps with the shoulder 62. Hence, the groove or recess 64 defined by the shoulder and the fascia of the top member of the main runner holds the cross-runner firmly in place. Also, when the members are assembled, the transverse marginal edge of flange 40 of the bottom member 26 of the cross-runner is brought into abutment with the longitudinal marginal edge of flange 40 of the bottom member 26 of the main runner 14. Thus, the flanges 40 of both runners are in a common plane, and when the grid assembly is complete and the tile panel 12 eased into place, the tiles likewise are disposed in a common plane. Because the grid system is characterized by high integrity, the ceiling is now secure.

By reason of the structural features of the grid system and the cooperation of the runner members, installation of the grid system of my invention is greatly simplified and installation can be accomplished in substantially less time as compared to a conventional system for a suspended ceiling. For example, in a typical prior art suspended ceiling system, a plurality of spaced apart lines are run (or a chalk line snapped) usually perpendicular to the joist to mark the locations of the main runners. Reference strings are suspended between opposed walls of the room, and hanger wires for suspending the main runners are attached to the joists directly above the reference strings. The main runners, which are suspended by the hanger wires, are positioned so that the cross-runners will align with the reference strings when the cross-runners are connected to the main runners. When all the main runners are up and suspended by the hanger wires, and also supported at the ends by a suitable angle bracket, the cross-runners are then connected to the main runners, thereby completing the grid.

Figure 17:
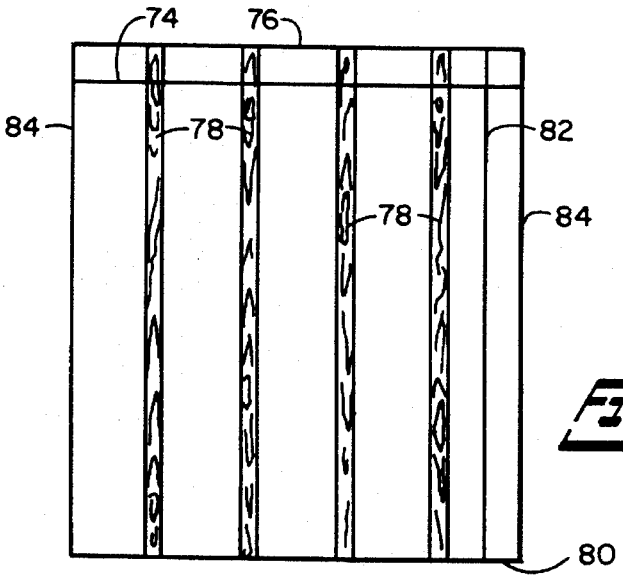
FIG. 17 is a plan view of a ceiling room showing the principal steps for the process of installation.

In accordance with the installation process of my invention, the cross-runners 16 extending between the main runners 14 are of equal length. As shown in FIG. 17, a first line 74 is run, drawn or otherwise formed substantially parallel to a wall 76 of the room, which typically would be perpendicular to the joists 78, which extend between walls 76 and 80, and at a predetermined distance from the wall of the room. This predetermined distance is preferably the distance from the wall 76 to the first main runner, which is the length of a cross-runner or less if necessary or desirable to provide for border panels on opposite sides of the room of equal size. A second line 82 is run, drawn, or otherwise formed substantially normal to the first line 74 so as to be in alignment with a notch of the top member of the main runner when the main runner is attached to the substructure (e.g., joist). The adjoining wall 84 is marked (as with a pencil marking) at spaced intervals about equal to the length of a cross-runner. This measurement need not be precise because the distance between main runners is determined by the length of the cross-runners, and as stated above the cross-runners extending between the main runners are of equal length. A main runner is then attached to the substructure along the first line 74 and between opposed walls 84 and 86.

One end of a cross-runner is connected to this main runner attached to the substructure, and a second main runner is positioned at the opposite end of this cross-runner and in substantial alignment with a wall marking. The second main runner is then attached to the substructure, and the remaining cross-runners for that row are connected to the first and second main runners. These steps are then repeated until the grid system is completed. At any time during the installation, the cross-runners extending between the wall and adjacent main runners at each end of the room may be connected at one end to the main runner and at the other end butt against an angle bracket, wall bracket or other suitable support means (not shown) attached to the wall at ceiling height, as explained above. When the cross-runners are arranged substantially perpendicular to the main runners, the horizontally disposed flanges of the cross-runners are in a common plane with the flanges of the main runners, and the flanges of the main runners and the flanges of the cross-runners support the tile panels in a common plane, as explained above. It thus will be observed that two lines only are drawn, regardless of the size of the room, and additional items or steps such as reference strings and hanger wires, and the positioning of these items, and the need for precise measurements are eliminated. As a consequence, installation of the grid system is simplified, and the time for installing the system is substantially reduced.

It will be observed that by reason of my invention numerous advantages are achieved with the ceiling grid system. Thus, there is provided a ceiling grid system of generally modular construction that is easy to install, that can support tile panels of varying thicknesses, and that provide a rugged and secure system. In addition, it will be observed that because the several members are snap fit, it is possible to snap and unsnap the grid system not only during installation but after the ceiling is in place, such when replacing a soiled or damaged tile. Further, it should be understood that the foregoing detailed description has been given for clearness of understanding only, and no unnecessary limitations should be understood therefrom, as modifications will be obvious to those skilled in the art.

Having described my invention and certain embodiment thereof, I claim:

1. A surface mounted grid system for use in association with a substructure and for supporting an array of tile panels, which comprises: (a) a plurality of main runners and cross-runners adaptable for spaced, horizontal disposition; (b) said main runners adaptable for attachment to said substructure, and including (i) a crosspiece having a horizontally oriented surface provided with a plurality of spaced notches and (ii) a downwardly depending member terminating with a horizontally disposed flange; (c) said cross-runners arranged substantially perpendicular to said main runners, and having a horizontally disposed flange arranged in a common plane with said flange of said main runner; (d) said flange of said main runners and said flange of said cross-runners disposed to support tile panels in a common plane; and (e) said cross-runners including connecting means for insertion in said notches upon said perpendicular arrangement, said connecting means including a horizontally oriented surface for mating with said surface of said crosspiece and disposed for overlapping engagement with said crosspiece thereby supporting said cross-runner and preventing undesired disengagement therebetween.

2. A surface mounted grid system according to claim 1 wherein said cross-runner comprises said flange and an intermediate longitudinal web extending transversely from said flange, said connecting means including said web terminating along its longitudinal marginal edge of said flange with a projection having an inwardly disposed planar surface adaptable to be received by said notch and for mating engagement with said planar surface of said crosspiece.

3. A surface mounted grid system according to claim 2 further including a horizontally disposed shoulder projecting from opposed sides of said web of said cross-runner and spaced below said projection at a distance slightly greater than the thickness of said crosspiece.

4. A surface mounted grid system according to claim 3 wherein said crosspiece has a substantially flat undersurface, and said shoulder abuts said undersurface of said crosspiece.

5. A surface mounted grid system according to any one of claims 1, 2, 3 or 4 wherein said main runner further includes a substantially flat fascia for attachment to said substructure, and said crosspiece depends laterally from said fascia and spaced therefrom to form a recess defined by said fascia and said crosspiece to accommodate said connecting means.

6. A surface mounted grid system according to claim 1 wherein said main runner further comprises (a) a top member having (i) a substantially flat fascia for attachment to said substructure, and (ii) spaced, non-peripheral, longitudinal side walls extending transversely from said fascia to provide a channel opening; and (b) a bottom member being of substantially T configuration in transverse cross-section having (i) a flange and (ii) an intermediate longitudinal web extending transversely from said flange, said web engageable in said channel and retained therein whereby said flange and said fascia define a recess adaptable to receive a tile panel; said crosspiece depending laterally from said fascia and spaced therefrom to form a recess defined by said fascia and said crosspiece to accommodate said connecting means; and said cross-runner comprises a flange and an intermediate longitudinal web extending transversely from said flange, said web terminating along its longitudinal marginal edge of said flange with a projection having an inwardly disposed planar surface to be received by said notch and for mating engagement with said surface of said crosspiece.

7. A surface mounted grid system according to claim 6 further including a horizontally disposed shoulder projecting from opposed sides of said web of said cross-runner and spaced below said projection at a distance slightly greater than the thickness of said crosspiece.

8. A surface mounted grid system according to claim 7 wherein said crosspiece has a substantially flat undersurface, and said shoulder abuts said undersurface of said crosspiece.

9. A surface mounted grid system according to claim 6 wherein said side walls are flexible to provide a flexural channel opening, and each side of said side walls having at least one inwardly disposed detent, and said bottom member of said main runner having at least one projection, whereby said web of said bottom member being engageable in said channel and said detent providing a co-operable interlocking element with said projection of said web of said bottom member to prevent undesired disengagement between said bottom member and said top member.

10. A surface mounted grid system for use in association with a substructure for supporting an array of tile panels, comprising: a plurality of spaced, horizontally disposed main runners and cross-runners, said cross-runners arranged substantially perpendicular to said main runners, each of said main runners and said cross-runners comprised of top members and bottom members; said top members having (i) a substantially flat fascia adaptable for attachment to said substructure, and (ii) spaced, non-peripheral, longitudinal, flexible side walls extending transversely from said fascia to provide a flexural channel opening; said bottom members being of substantially T configuration in transverse cross-section having (i) a flange and (ii) an intermediate longitudinal web extending transversely therefrom and having at least one projection, said web engageable in said channel and retained therein whereby said flange and said fascia define a groove adaptable to receive a tile panel; said fascia of said top member of the main runner further including a plurality of spaced notches adaptable to receive said side walls of said top member of the cross-runner upon said perpendicular arrangement and to provide overlapping engagement of the fascia of the top member of the cross-runner with the fascia of the top member of the main runner; and each of said side walls of said top member having at least one inwardly disposed detent providing a co-operable interlocking element with said projection of said web of said bottom member to prevent undesired disengagement therebetween.

11. A surface mounted grid system according to claim 10 wherein said detent is disposed inwardly from the longitudinal marginal edge of said side wall.

12. A surface mounted grid system according to claim 10 wherein the transverse marginal edge of said flange of said lower member of the cross-runner abuts the longitudinal marginal edge of said flange of said bottom member of the main runner.

13. A surface mounted grid system according to claim 11 or claim 12 wherein said projection has an inwardly disposed shoulder substantially normal to said web for mating engagement with said shoulder of said detent.

14. A surface mounted grid system according to claim 10 wherein said web of said bottom member has a first projection adjacent the longitudinal marginal edge of said web and extending substantially the full length thereof, and a second projection spaced inwardly from said first projection and extending substantially the full length thereof.

15. A surface mounted grid system according to any one of claims 10, 11 or 12 wherein said detent has a horizontally oriented shoulder substantially normal to said side walls, and said web has a first and second projection, said first projection having a shoulder and disposed adjacent the longitudinal marginal edge of said web extending substantially the full length thereof, said shoulder of said first projection adaptable for mating engagement with said shoulder of said detent upon engagement of said web in said channel, and said second projection spaced inwardly from said first projection and extending substantially the full length of said web.

16. A surface mounted grid system according to claim 15 wherein said detent is disposed inwardly from the longitudinal marginal edge of said side wall.

17. A surface mounted grid system to support an array of tile panels and adaptable for use in association with a substructure, comprising: a plurality of spaced, horizontally disposed main runners and cross-runners, said cross-runners arranged substantially perpendicular to said main runners, each of said main runners and said cross-runners comprised of top members and bottom members; said top members having (i) a substantially flat fascia adaptable for attachment to said substructure, (ii) spaced, non-peripheral, longitudinal, flexible side walls extending transversely from said fascia to provide a flexural channel opening, and (iii) lateral shoulders disposed substantially parallel to and spaced below said fascia of said top member of the main runner to define a re-entrant groove for seating the transverse, longitudinal marginal edge portion of said fascia of said top member of the cross-runner and within said groove; said bottom members being of substantially T configuration in transverse cross-section having (i) a flange and (ii) an intermediate transverse web extending longitudinally therefrom and having at least one projection, said web engageable in said channel and retained therein whereby said flange and said fascia define a groove adaptable to receive a tile panel; said lateral shoulders of said top member of the main runner further including a plurality of spaced notches adaptable to receive said side walls of said top member of the cross-runner upon said perpendicular arrangement and to provide overlapping engagement of the fascia of the top member of the cross-runner with said lateral shoulder of the top member of the main runner; and each of said side walls of said top member having at least one inwardly disposed detent providing a co-operable interlocking element with said projection of said web of said bottom member to prevent undesired disengagement therebetween.

18. A surface mounted grid system according to claim 17 further including a flange extending downwardly from said fascia of said top member of the main runner, and said lateral shoulder extending transversely from said downwardly extending flange.

19. A surface mounted grid system according to claim 18 wherein said lateral shoulder extends intermediate the extremities of said flange, whereby on said perpendicular arrangement the transverse marginal edges of said channel walls abut said flange below said lateral shoulder.

20. A surface mounted grid system for supporting an array of tile panels, and including a plurality of (i) main runners and (ii) cross-runners of substantially equal length and arranged substantially perpendicular to said main runners, installed on a substructure of a room having adjoining walls, by the process which comprises: (a) running a first line substantially parallel to a first wall and at a predetermined distance from said first wall along which a first main runner is to be attached, each of said main runners comprising (i) a top member adaptable for attachment to the substructure and including a crosspiece having a horizontally oriented surface provided with a plurality of spaced notches and (ii) a downwardly depending member terminating with a horizontally disposed flange for supporting a tile panel along a marginal edge; (b) running a second line substantially normal to said first line and in alignment with a notch of said top member when in an attached position to said substructure; (c) marking an adjoining second wall at spaced intervals about equal to the length of said cross-runners, said cross-runners having a horizontally disposed flange for supporting a tile panel along a marginal edge and further including connecting means cooperable with said notches for perpendicular arrangement with said main runner, said connecting means including a horizontally oriented surface for mating with said surface of said crosspiece and disposed for overlapping engagement with said crosspiece thereby supporting said cross-runner and preventing undesired disengagement therebetween; (d) attaching said first main runner to said substructure along said first line and between opposed walls; (e) connecting one end of a cross-runner with said first main runner attached to said substructure, and positioning a second main runner at the opposed end of said cross-runner connected to said first main runner and in substantial alignment with a wall marking; (f) attaching said second main runner to said substructure; (g) connecting the remaining cross-runners between said first and second main runner and between said first main runner and said wall; and (h) repeating the steps of (e), (f) and (g) until the grid system is complete, whereby said flanges of said cross-runners are disposed in a common plane with said flanges of said main runners.

21. A surface mounted grid system installed by the process of claim 20 and further including attaching a support means at ceiling height to the walls for supporting the ends of the main runners and cross-runners abutting the walls, and connecting cross-runners between the main runners adjacent the walls and the support means.

* * * * *